US011679043B2

(12) United States Patent
Hart

(10) Patent No.: US 11,679,043 B2
(45) Date of Patent: Jun. 20, 2023

(54) HYDRAULIC SYSTEM FOR A MOBILE RESCUE STRETCHER AND MOBILE RESCUE STRETCHER

(71) Applicant: HAWE Hydraulik SE, Aschheim (DE)

(72) Inventor: Christian Hart, Nittendorf (DE)

(73) Assignee: HAWE HYDRAULIK SE, Aschheim (DE)

( * ) Notice: Subject to any disclaimer, the term of this patent is extended or adjusted under 35 U.S.C. 154(b) by 0 days.

(21) Appl. No.: 17/669,769

(22) Filed: Feb. 11, 2022

(65) Prior Publication Data

US 2022/0347023 A1 Nov. 3, 2022

(30) Foreign Application Priority Data

Apr. 29, 2021 (DE) ..... 102021204291.0

(51) Int. Cl.
*A61G 1/056* (2006.01)
*F15B 7/00* (2006.01)

(52) U.S. Cl.
CPC ..... *A61G 1/0567* (2013.01); *F15B 7/006* (2013.01); *F15B 2211/20515* (2013.01);
(Continued)

(58) Field of Classification Search
CPC .. F15B 7/006; F15B 9/08; F15B 20/00; F15B 2211/20515; F15B 2211/20561;
(Continued)

(56) References Cited

U.S. PATENT DOCUMENTS 6,470,678 B1 * 10/2002 Huber ..... B62D 25/12 60/476
7,254,945 B1 * 8/2007 Sakai ..... F15B 7/006 60/476

(Continued)

FOREIGN PATENT DOCUMENTS

WO 2005/122989 A1 12/2005
WO 2019/201579 A1 10/2019

OTHER PUBLICATIONS

German Patent and Trademark Office, Examination Report issued in corresponding German application No. 10 2021 204 291.0, dated Jan. 17, 2022, 10 pp.

*Primary Examiner* — Michael Leslie
(74) *Attorney, Agent, or Firm* — Dinsmore & Shohl LLP

(57) ABSTRACT

A hydraulic system for a mobile rescue stretcher has a hydraulic cylinder, with first and second working chambers, a tank and pump. The first and second chambers are connected to the pump via first and second line arrangements, respectively, and can be pressurized by the pump. Hydraulic fluid flows out of the first chamber via the first line arrangement when pressure is applied to the second chamber. The first line arrangement has a first check valve which opens when pressure is applied to the second line arrangement. Hydraulic fluid flows out of the second chamber via the second line arrangement when pressure is applied to the first chamber. The second line arrangement has a first branch line connected to the pump and a second branch line connected to the tank. A pressure valve in the second branch line opens when pressure is applied to the second line arrangement.

11 Claims, 3 Drawing Sheets

(52) U.S. Cl.
CPC . *F15B 2211/20561* (2013.01); *F15B 2211/27* (2013.01); *F15B 2211/3051* (2013.01); *F15B 2211/50518* (2013.01); *F15B 2211/7053* (2013.01); *F15B 2211/761* (2013.01); *F15B 2211/785* (2013.01); *F15B 2211/895* (2013.01)

(58) Field of Classification Search
CPC .... F15B 2211/20538; F15B 2211/3051; F15B 2211/7053; F15B 2211/785
See application file for complete search history.

(56) References Cited

U.S. PATENT DOCUMENTS

| | | | | |
|---|---|---|---|---|
| 7,398,571 | B2 | 7/2008 | Souke et al. | |
| 7,996,939 | B2 * | 8/2011 | Benedict | A61G 1/0237 5/614 |
| 10,987,260 | B2 * | 4/2021 | Souke | A61G 1/0567 |
| 11,219,562 | B2 * | 1/2022 | Roider | A61G 1/02 |
| 2006/0075558 | A1 | 4/2006 | Lambarth | |
| 2009/0172883 | A1 | 7/2009 | Benedict | |
| 2015/0260204 | A1 | 9/2015 | Tanaka | |
| 2018/0303685 | A1 | 10/2018 | Souke | |
| 2021/0121339 | A1 * | 4/2021 | Lucas | A61G 1/0212 |
| 2021/0369513 | A1 | 12/2021 | Roider et al. | |

* cited by examiner

- State of the Art -

HYDRAULIC SYSTEM FOR A MOBILE RESCUE STRETCHER AND MOBILE RESCUE STRETCHER

CROSS-REFERENCE TO RELATED APPLICATIONS

This application claims priority to German application number 10 2021 204 291.0 filed Apr. 29, 2021, the disclosure of which is hereby incorporated by reference in its entirety.

FIELD OF THE INVENTION

The present invention relates to a hydraulic system for a mobile rescue stretcher comprising a hydraulic cylinder, a tank and a pump. Furthermore, the invention relates to a mobile rescue stretcher with such a hydraulic system.

BACKGROUND OF THE INVENTION

The hydraulic cylinder regularly has a piston with at least one piston rod, a first working chamber and a second working chamber separated from the first working chamber by the piston. The first working chamber is regularly the piston working chamber and the second working chamber is regularly the rod working chamber.

The first working chamber is connected to the pump via a first line arrangement and the second working chamber is connected to the pump via a second line arrangement. Depending on whether the hydraulic cylinder is to be retracted or extended, the first working chamber can be pressurized by the pump via the first line arrangement or the second working chamber can be pressurized by the pump via the second line arrangement. When pressure is applied to the second working chamber, hydraulic fluid can flow out of the first working chamber via the first line arrangement in that the first line arrangement has a first check valve that can be opened when pressure is applied to the second line arrangement. When pressure is applied to the first working chamber, hydraulic fluid flows out of the second working chamber via the second line arrangement. The hydraulic fluid flowing out of the working chambers flows to the tank or is sucked in again directly by the pump.

In mobile rescue stretchers, these hydraulic systems are used to change the height of a patient support of the rescue stretcher in relation to a chassis of the rescue stretcher. Commonly, such rescue stretchers have a scissor jack structure that is connected to the patient support on the one hand and to the chassis on the other. To change the height level of the patient support, the hydraulic cylinder is extended or retracted accordingly. Such a rescue stretcher is known, for example, from WO 2019/201579 A1.

One disadvantage of the known solutions, however, is that the first check valve can "stutter" when the hydraulic cylinder is retracted if an additional force acts in the retraction direction of the hydraulic cylinder. This condition is referred to below as a pulling load and can be caused, for example, by a patient lying on the patient support.

SUMMARY OF THE INVENTION

When the hydraulic cylinder is retracted, the control pressure to open the first check valve is generated by pressurizing the second line arrangement and thus the second working chamber (i.e., the rod working chamber). The volume of hydraulic fluid displaced from the first working chamber (i.e., the piston working chamber) is greater than the volume of hydraulic fluid to be delivered into the second working chamber, so that only a portion of the displaced hydraulic fluid is delivered directly back into the second working chamber. The excess volume must be removed from the hydraulic circuit and fed into the tank. Due to a pulling load, however, the pump volume flow then generated by the pump may no longer be sufficient to deliver the required hydraulic fluid volume for the second working chamber. This causes the control pressure applied to the first check valve to collapse and the first check valve to close. The retracting movement of the hydraulic cylinder then stops. As soon as a sufficient back pressure has built up, the delivered volume of the pump is sufficient again and the control pressure builds up again. The first check valve opens again and the hydraulic cylinder continues to retract. However, since a pulling load is still acting, the control pressure collapses again promptly and the first check valve closes again.

This stuttering of the first check valve can lead to damage to the seat of the valve and cause the entire hydraulic system to oscillate. Furthermore, this also results in an unpleasant situation for the operator as well as the patient.

To prevent this, a nozzle can be integrated in the first line arrangement to reduce the retraction speed of the hydraulic cylinder. An exemplary hydraulic circuit diagram is shown here in FIG. 1.

The hydraulic system 101 comprises a hydraulic cylinder 102, a tank 103, and a pump 104. The hydraulic cylinder 102 has a piston 105 with a piston rod 106 that separates a first working chamber 107 from a second working chamber 108. Here, the first working chamber 107 is the piston working chamber and the second working chamber 108 is the rod working chamber. The piston rod 106 is connected to the patient support (not shown) to vary the height of the patient support relative to the chassis (not shown). The piston working chamber 107 is selectively connectable to the pump 104 or the tank 103 via a first line arrangement 109. Accordingly, the rod working chamber 108 is also connectable to the pump 104 or the tank 103 via a second line arrangement 110. As shown, the connection between the line arrangements 109, 110 and the tank 103 or the pump 104 is made via corresponding valves, although other solutions are also conceivable, as known, for example, from WO 2019/201579 A1.

Furthermore, a first check valve 111 is disposed in the first line arrangement 109 and a second check valve 112 is disposed in the second line arrangement 110. The first check valve 111 is connected to the second line arrangement 110 via a first control line 113 and the second check valve 112 is connected to the first line arrangement 109 via a second control line 114, so that the respective check valve 111, 112 is opened when pressure is applied to the respective line arrangement 109, 110. For example, if pressure is applied to the second line arrangement 110 to retract the hydraulic cylinder 102, the pressure in the second line arrangement 110 is signaled to the first check valve 111 via the first control line 113, and the check valve 111 is consequently opened. The hydraulic fluid volume from the piston working chamber 107 can thus flow out to the tank 103 via the first line arrangement 109. Furthermore, a nozzle 115 is disposed in the first line arrangement 109 between the first check valve 111 and the piston working chamber 107. Via this nozzle 115, the volume flow is limited so that the retraction speed of the hydraulic cylinder 102 is limited.

The solution described with reference to FIG. 1 effectively prevents the first check valve from stuttering. However, the nozzle 115 is active both during retraction and extension of the hydraulic cylinder 102. In other words, the nozzle is active not only when the patient support is lowered with the patient lying on it (the so-called "lower load") but also when the chassis is retracted quickly, for example, when the patient support is to be hooked into an ambulance car (the so-called "retract"). This consumes unnecessary energy, generates heat and reduces the speed during the retract.

Based on this, it is the object of the present invention to provide a hydraulic system for a mobile rescue stretcher, in which stuttering of the check valve can be effectively prevented when a pulling load is present, without causing restrictions in the functionality of the rescue stretcher.

The solution of the problem is achieved with a hydraulic system as disclosed herein. Preferable embodiments are also described.

The hydraulic system according to the invention is characterized over solutions known in the prior art in particular in that the second line arrangement comprises a first branch line and a second branch line. The first branch line is connected to the pump and the second branch line is connected to the tank. According to the invention, a pressure valve is disposed in the second branch line, which opens when pressure is applied to the second line arrangement via the pump, so that the pressure in the second line arrangement is limited to a pressure sufficient to open the first check valve. The pressure valve is preferably a pressure relief valve and preferably opens at a pressure of at most 100 bar, in particular at most 75 bar.

Thus, the pressure in the second line arrangement is limited to the pressure set at the pressure valve, which is below the pump pressure. This limited pressure is sufficient to open the first check valve. At the same time, the excess volume flow can be directed to the tank via the pressure valve and thus removed from the circuit. Thus, even in case a pulling load acts, the control pressure applied to the first check valve does not collapse and consequently the first check valve does not stutter. This also allows sufficient speed to be achieved both during retract and during lower load.

Preferably, a second check valve is disposed in the first branch line, the second branch line branching off from the second line arrangement downstream of the second check valve, as seen in the direction of flow from the pump to the hydraulic cylinder. The second check valve causes the piston rod working chamber to be relieved via the pressure valve to the tank when the hydraulic cylinder is extended.

Preferably, the second line arrangement comprises a third branch line, wherein the third branch line is connected to the tank and branches off from the first branch line. According to the invention, a nozzle is disposed in the third branch line. Via this nozzle, it can be ensured that the control pressure for opening the first check valve is relieved when the retraction of the cylinder is stopped and the first check valve closes safely. This effectively prevents the patient support from sinking.

Preferably, the third branch line comprises a bypass line bypassing the nozzle with a fourth check valve disposed in the third branch line. This allows a larger volume of hydraulic fluid to be drawn from the tank via the pump when the first working chamber is pressurized.

Preferably, the first line arrangement comprises a fourth branch line connected to the tank, a fourth check valve which can be opened when the second line arrangement is pressurized being disposed in the fourth branch line. Here, it is particularly advantageous if a hydraulic resistor is disposed in the fourth branch line upstream of the fourth check valve in the direction of flow from the first working chamber to the tank, the hydraulic resistor being in particular a nozzle. Accordingly, it can be ensured that a partial volume flow of the excess volume flow is delivered directly into the tank. Hence, the overall power loss can be reduced, since the entire excess volume flow does not have to flow off to the tank via the pressure valve.

Furthermore, the solution of the problem is achieved with a mobile rescue stretcher as disclosed herein. According to the invention, the rescue stretcher has a hydraulic system described above.

BRIEF DESCRIPTION OF THE DRAWINGS

The invention is explained in more detail below with reference to the figures. Here it is schematically shown.

DETAILED DESCRIPTION OF THE INVENTION

Figure 1:
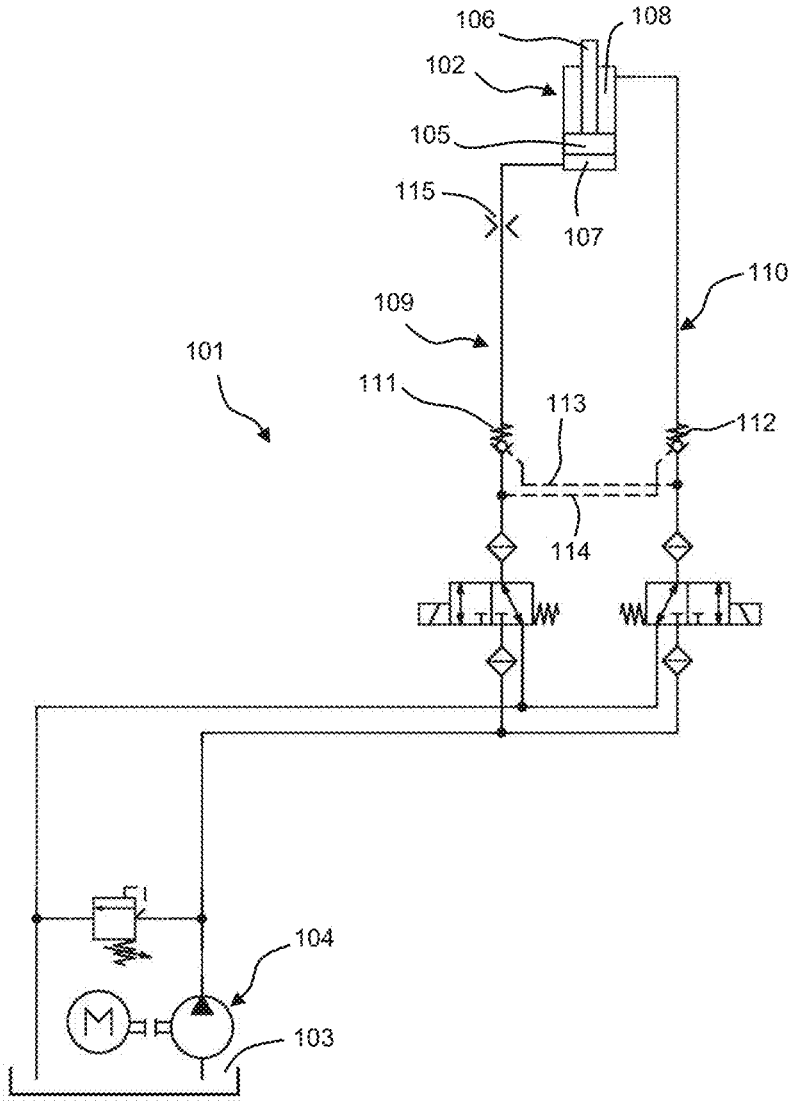
FIG. 1 is a hydraulic circuit diagram of a hydraulic system known from the prior art, as described above.
Figure 2:
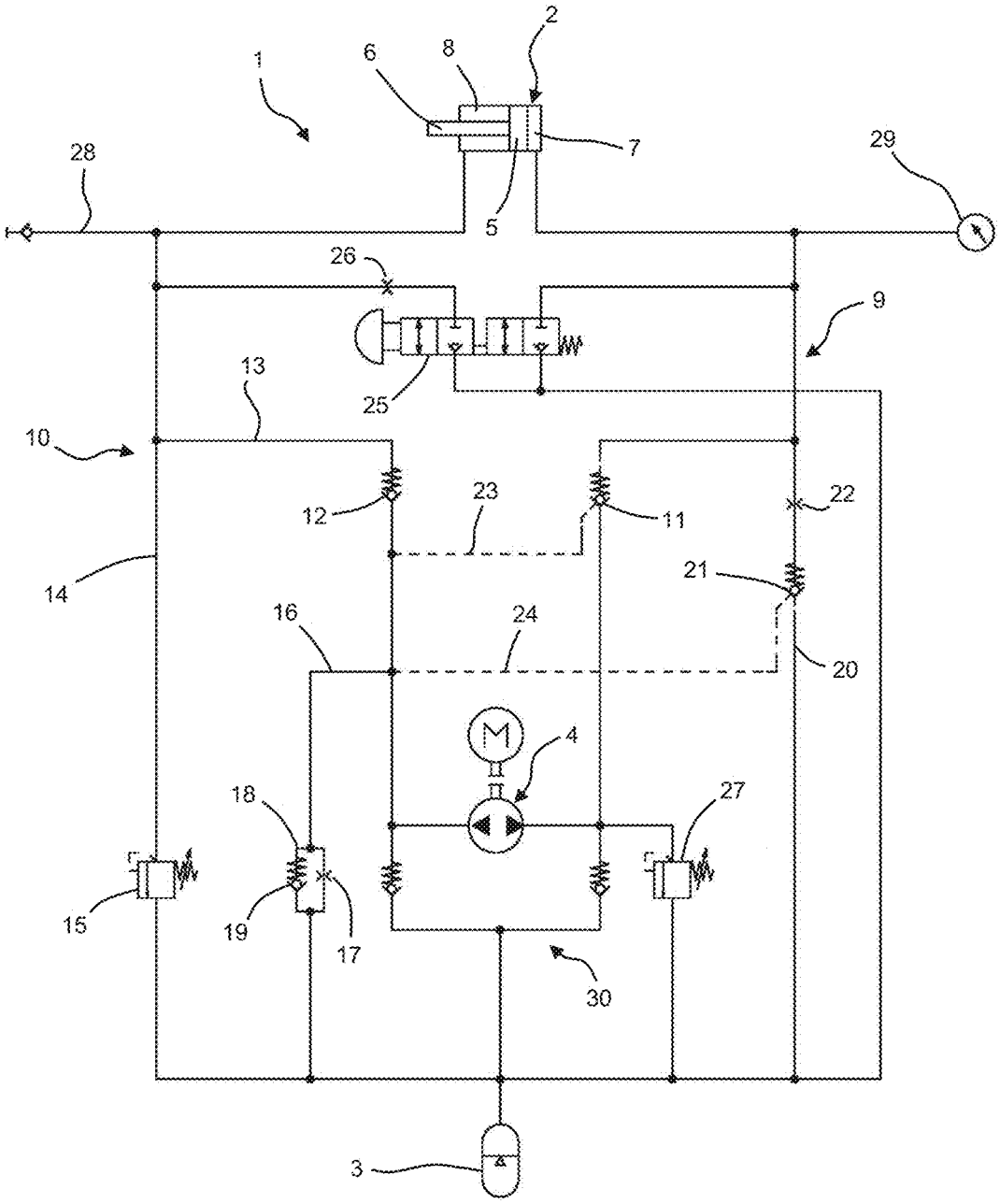
FIG. 2 is a hydraulic circuit diagram of a hydraulic system according to the invention.

FIG. 2 shows a hydraulic circuit diagram of a hydraulic system 1 according to the invention for a mobile rescue stretcher 50. The rescue stretcher 50 is described in more detail below with reference to FIG. 3. The hydraulic system 1 comprises a hydraulic cylinder 2, a tank 3 and a pump 4. In this exemplary embodiment, the tank 3 is configured as a hydraulic accumulator, although other configuration are also possible, for example as shown in FIG. 1.

The hydraulic cylinder 2 has a piston 5 with a piston rod 6, which separates a first working chamber 7 and a second working chamber 8. In this exemplary embodiment, the first working chamber 7 is the piston working chamber and the second working chamber 8 is the rod working chamber. The piston working chamber 7 is connected to the pump 4 via a first line arrangement 9, and the rod working chamber 8 is connected to the pump 4 via a second line arrangement 10. The pump 4 is configured to pressurize either the piston working chamber 7 via the first line arrangement 9 or the rod working chamber 8 via the second line arrangement 10. Accordingly, the hydraulic fluid of the respective other working chamber 7, 8, which is not pressurized, flows off via the respective line arrangement 9, 10.

Therefore, the hydraulic system 1 comprises a first check valve 11 disposed in the first line arrangement. The first check valve 11 is configured as a spring-loaded check valve and is connected to the second line arrangement 10 via a first control line 23 in such a way that the first check valve 11 is opened when pressure is applied to the second line arrangement 10 or the rod working chamber 8 to retract the hydraulic cylinder 2. The hydraulic fluid displaced from the piston working chamber 7 can thus be sucked in directly, at least partially, via the first line arrangement 9 and the pump 4.

Due to the piston rod 6, not all of the hydraulic fluid volume of the piston working chamber 7 can be delivered directly via the pump into the rod working chamber 8 when the hydraulic cylinder 2 is retracted as described above. In order to remove the excess hydraulic fluid volume from the circuit, the second line arrangement 10 comprises a first branch line 13 and a second branch line 14. The first branch line 13 is connected to the pump 4 and a second check valve 12 is disposed in the first branch line 13. In this exemplary embodiment, the second check valve 12 is also configured as a spring-loaded check valve. In the direction of flow from the pump 4 to the rod working chamber 8, the second branch line 14 branches off downstream of the second check valve 12. The first control line 23 branches off upstream of the second check valve 12.

The second branch line 14 is connected to the tank and a pressure valve 15 configured as a pressure relief valve is disposed in the second branch line 14. The pressure relief valve 15 limits the pressure in the second line arrangement 10 to a maximum of 100 bar, in particular to a maximum of 75 bar. This pressure is sufficient to open the first check valve 11 via the first control line 23. At the same time, the excess hydraulic fluid volume is delivered to the tank via the pressure relief valve 15 when the hydraulic cylinder 2 is retracted. This prevents the first check valve 11 from stuttering due to a collapsing control pressure in the first control line 23.

To prevent subsidence when the retraction of the hydraulic cylinder 2 stops, the second line arrangement 10 comprises a third branch line 16, which branches off from the first branch line 13 between the pump 3 and the second check valve 12 and which is connected to the tank 3. A nozzle 17 is disposed in the third branch line 16. A rather small nozzle 17 is selected. When the retraction of the cylinder is stopped, the second check valve 12 closes and a residual pressure remains between the pump 4 and the second check valve 12. The residual pressure present in the second line arrangement 9 and signaled via the first control line 23 can now be safely relieved via the nozzle 17, so that the first check valve 11 closes safely. Further movement of the hydraulic cylinder 2 is thus prevented.

Furthermore, the third branch line 16 has a bypass line 18 bypassing the nozzle 17 with a third check valve 19, which is also configured as a spring-loaded check valve. When the first line arrangement 9 is pressurized to extend the hydraulic cylinder 2, hydraulic fluid can thus be sucked directly from the tank 3 via the third branch line 16 and the bypass line 18.

The first line arrangement 9 comprises a fourth branch line 20 connected to the tank 3. The fourth branch line 20 branches off in the direction of flow from the pump 3 to the piston working chamber 7 downstream of the first check valve 11. A fourth check valve 21, which is also spring-loaded, is disposed in the fourth branch line 20 and is connected to the second line arrangement 10 via a second control line 24 in such a way that it is opened when the second line arrangement 10 is pressurized. The second control line 24 branches off from the second line arrangement 10 or the first branch line 13 respectively between the pump 3 and the second check valve 12. A hydraulic resistor 22 in the form of a nozzle is disposed upstream of the fourth check valve 21. This allows a defined partial volume of the hydraulic fluid volume displaced from the piston working chamber 7 to be withdrawn from the circuit when the hydraulic cylinder 2 is retracted. This makes it possible to retract the hydraulic cylinder 2 more quickly overall.

As shown, the hydraulic system 1 has a manually operable emergency valve 25 which connects the piston working chamber 7 and the rod working chamber 8 directly to the tank 3. To prevent unimpeded subsidence when the emergency valve 25 is actuated, a nozzle 26 is disposed between the rod working chamber 8 and the emergency valve 25.

Furthermore, the hydraulic system 1 further comprises an emergency pressure relief valve 27 connecting the first line arrangement 9 to the tank 3. The emergency pressure relief valve 27 is set to a pressure of more than 200 bar and prevents damage to the hydraulic system 1 that could otherwise occur if the hydraulic cylinder 2 is blocked from the outside or if the hydraulic cylinder 2 moves to its end stop. Furthermore, also by the fact that, for example, pressure increases could occur due to temperature or solar radiation. The hydraulic system 1 also has an optional external connection 28 and optionally a pressure gauge 29.

The hydraulic system 1 also has a suction arrangement 30 via which the pump 4 can directly suck hydraulic fluid from the tank 3. A configuration with two spring-loaded check valves is shown, although other configurations are also conceivable, for example with a shuttle valve.

Figure 3:
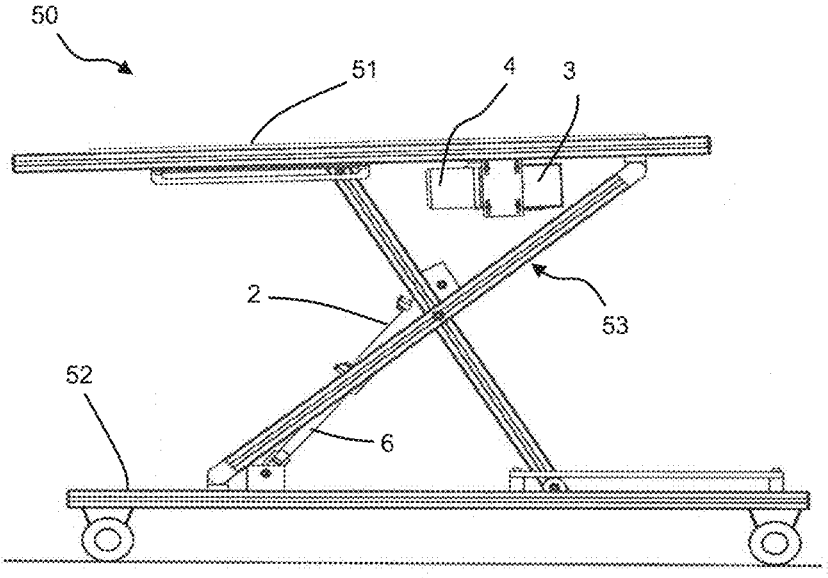
FIG. 3 is a side view of a rescue stretcher with a hydraulic system according to the invention.

FIG. 3 shows a side view of a mobile rescue stretcher 50 according to the invention. The rescue stretcher 50 has a patient support 51, a chassis 52, a scissor jack structure 53 and a hydraulic system 1 described above. The hydraulic cylinder 2 is attached to the scissor jack structure 53 and the chassis 52 such that pressurization of the first line arrangement 9, and consequently of the piston working chamber 7, raises the patient support 51 relative to the chassis 52. Accordingly, the patient support 51 is lowered relative to the chasses 52 when the second line arrangement 10 and thus the rod working chamber 8 are pressurized.

In the following, a lifting of the patient support 51 is described first. For this purpose, the pump 4 is controlled in such a way that the first line arrangement 9 is pressurized. This opens the first check valve 11 and hydraulic fluid flows into the piston working chamber 7 and the hydraulic cylinder 2 extends. The hydraulic fluid displaced from the rod working chamber 8 can flow out to the tank 3 via the second line arrangement 10 and the second branch line 14, since the pressure exceeds the pressure set at the pressure relief valve 15 and the pressure relief valve 15 consequently opens. The pump 3 sucks in hydraulic fluid from the tank 3 via the fourth branch line 16 and the bypass line 18 as well as via the suction arrangement 30. As soon as the desired height of the patient support 51 is reached, the pump 3 is switched off and the position of the hydraulic cylinder 2 is maintained via the first check valve 11 and the fourth check valve 21.

To lower the patient support 51, the pump 4 is controlled to pressurize the second line arrangement 10. The first check valve 11 and the fourth check valve 21 are controlled to open via the control pressure signaled by the first and second control lines 23, 24. The hydraulic fluid displaced from the piston working chamber 7 can thus be sucked back in directly via the pump 4 or partially flow out to the tank 3 via the fourth branch line 20. Due to the pressure in the second line arrangement 10 or in the first branch line 13, the second check valve 12 is opened and hydraulic fluid can flow into the rod working chamber 8. The excess volume of hydraulic fluid flowing out of the piston working chamber 7 is delivered to the tank 3 via the pressure relief valve 15 and the pressure in the second line arrangement 9 is limited to the pressure set at the pressure relief valve 15.

As soon as the desired height of the patient support 51 is reached, the pump 4 is stopped. The second check valve 12 closes and the control pressure in the first control line 23 and in the second control line 24 is relieved via the third branch line 16 and the nozzle 17 to tank 3. Thus, the first check valve 11 and the fourth check valve 21 close and the position of the patient support 51 is maintained.

The above functional descriptions of the mobile rescue stretcher 50 also apply accordingly to a rapid retraction ("retract") or extension (the so-called "extend") of the chassis 51, i.e. for a situation in which no patient is accommodated on the patient support 51. This is necessary, for example, when the patient support 51 is to be hooked into an ambulance car or is removed from the ambulance car.

The invention claimed is:

1. A hydraulic system for a mobile rescue stretcher, comprising:

a hydraulic cylinder having a piston with at least one piston rod, a first working chamber and a second working chamber separated from the first working chamber by the piston;

a tank;

a pump;

wherein the first working chamber of the hydraulic cylinder is connected to the pump via a first line arrangement and the second working chamber is connected to the pump via a second line arrangement;

wherein the first working chamber can be pressurized by the pump via the first line arrangement or the second working chamber can be pressurized by the pump via the second line arrangement, hydraulic fluid flowing out of the first working chamber via the first line arrangement when pressure is applied to the second working chamber;

the first line arrangement comprising a first check valve which is opened when pressure is applied to the second line arrangement; and hydraulic fluid flowing out of the second working chamber via the second line arrangement when the first working chamber is pressurized;

wherein the second line arrangement comprises a first branch line connected to the pump and a second branch line connected to the tank, a second check valve disposed in the first branch line preventing flow back to the pump, a pressure valve being disposed in the second branch line and opening when pressure is applied to the second line arrangement, so that the pressure in the second line arrangement is limited to a pressure sufficient to open the first check valve;

wherein the pressure in second line arrangement is limited to a pressure set at the pressure valve;

the pressure set at the pressure valve is below a pump pressure;

an excess volume of hydraulic fluid from the first working chamber is directed to the tank via the pressure valve when the second working chamber is pressurized by the pump via the second line arrangement; and a volume of hydraulic fluid from the second working chamber flows through the second branch line through the pressure valve when the hydraulic cylinder extends.

2. The hydraulic system according to claim 1, wherein the pressure valve is a pressure relief valve.

3. The hydraulic system according to claim 1, wherein the pressure valve opens at a pressure of at most 100 bar.

4. The hydraulic system according to claim 1, wherein the pressure valve opens at a pressure of at most 75 bar.

5. The hydraulic system according to claim 1, wherein the second line arrangement comprises a third branch line connected to the tank, the third branch line branching off from the first branch line, and a nozzle being disposed in the third branch line.

6. The hydraulic system according to claim 5, wherein the third branch line comprises a bypass line bypassing the nozzle, wherein a third check valve is disposed in the bypass line.

7. The hydraulic system according to claim 1, wherein the first line arrangement comprises a fourth branch line connected to the tank, and a fourth check valve which can be opened when pressure is applied to the second line arrangement being disposed in the fourth branch line.

8. The hydraulic system according to claim 7, wherein a hydraulic resistor is disposed in the fourth branch line.

9. The hydraulic system according to claim 8, wherein the hydraulic resistor is a nozzle.

10. The hydraulic system according to claim 8, wherein the hydraulic resistor is disposed upstream of the fourth check valve in the fourth branch line in a direction of flow from the first working chamber to the tank.

11. A mobile rescue stretcher comprising a hydraulic system according to claim 1.

* * * * *